US008665174B2

(12) United States Patent
McCarthy

(10) Patent No.: US 8,665,174 B2
(45) Date of Patent: Mar. 4, 2014

(54) TRIANGULAR PHASED ARRAY ANTENNA SUBARRAY

(75) Inventor: Bradley L. McCarthy, El Segundo, CA (US)

(73) Assignee: The Boeing Company, Chicago, IL (US)

( * ) Notice: Subject to any disclaimer, the term of this patent is extended or adjusted under 35 U.S.C. 154(b) by 51 days.

(21) Appl. No.: 13/005,760

(22) Filed: Jan. 13, 2011

(65) Prior Publication Data

US 2012/0268344 A1 Oct. 25, 2012

(51) Int. Cl.
*H01Q 21/00* (2006.01)
*H01Q 1/42* (2006.01)

(52) U.S. Cl.
USPC ..... 343/893; 343/872; 343/810; 343/853

(58) Field of Classification Search
None
See application file for complete search history.

(56) References Cited

U.S. PATENT DOCUMENTS

| | | | | |
|---|---|---|---|---|
| 5,484,330 | A * | 1/1996 | Flood et al. | 451/540 |
| 5,589,834 | A | 12/1996 | Weinberg | |
| 5,923,289 | A | 7/1999 | Buer et al. | |
| 6,297,775 | B1 * | 10/2001 | Haws et al. | 343/700 MS |
| 6,359,599 | B2 | 3/2002 | Apostolos | |
| 6,424,313 | B1 | 7/2002 | Navarro et al. | |
| 6,448,938 | B1 | 9/2002 | Chiang et al. | |
| 6,825,815 | B1 | 11/2004 | Harmon | |
| 7,034,748 | B2 | 4/2006 | Kajiya | |
| 7,202,830 | B1 | 4/2007 | Brown et al. | |
| 7,260,141 | B2 | 8/2007 | Bierly et al. | |
| 7,397,425 | B2 | 7/2008 | Ranta et al. | |
| 7,609,205 | B2 | 10/2009 | Haskell | |
| 8,081,118 | B2 * | 12/2011 | McCarthy et al. | 343/700 MS |
| 8,331,105 | B2 * | 12/2012 | Chikamichi | 361/780 |
| 2003/0043071 | A1 | 3/2003 | Lilly et al. | |
| 2007/0097006 | A1 | 5/2007 | Brown et al. | |
| 2009/0284436 | A1 * | 11/2009 | McCarthy et al. | 343/872 |

FOREIGN PATENT DOCUMENTS

| | | | |
|---|---|---|---|
| EP | 2120283 | A1 | 11/2009 |
| WO | 0120722 | A1 | 3/2001 |
| WO | 2006110026 | A1 | 10/2006 |

OTHER PUBLICATIONS

Masa-Campos, et al, Triangular Planar Array of a Pyramidal Adaptive Antenna for Satellite Communications at 1.7 GHz, Microwave and Optical Technology Letters, vol. 51, No. 11, Nov. 2009.

European Search Report for application 12151167.9-2220 dated May 10, 2012.

* cited by examiner

*Primary Examiner* — Trinh Dinh
(74) *Attorney, Agent, or Firm* — Caven & Aghevli LLC

(57) ABSTRACT

Antenna subassemblies suitable for use in phased array antennas are disclosed, as are phased array antenna assemblies and aircraft comprising phased array antenna assemblies. In one embodiment, an antenna subarray assembly comprises a thermally conductive foam substrate, a plurality of radiating elements bonded to the foam substrate, and a radome disposed adjacent the radiating elements. The subarray assembly presents a triangular shape when viewed in plan view, and the plurality of radiating elements are arranged in a triangular array on the foam substrate. In some embodiments, a plurality of subarray assemblies may be assembled to form an antenna assembly. In further embodiments an aircraft may be fitted with one or more antenna assemblies. Other embodiments may be described.

20 Claims, 6 Drawing Sheets

TRIANGULAR PHASED ARRAY ANTENNA SUBARRAY

BACKGROUND

The subject matter described herein relates to electronic communication and radar systems and to configurations for antenna arrays for use in electronic communication and radar applications.

Aircraft, including spacecraft, commonly incorporate communication systems which utilize an antenna array to communicate with ground-based systems. Phased array antennas find utility in both airborne communication systems and ground-based communication systems. Aircraft, and particularly spacecraft, have limited power sources and therefore must manage power resources. Accordingly, power-efficient phased array antenna systems may find utility.

SUMMARY

In one embodiment, an antenna subarray assembly comprises a thermally conductive foam substrate, a plurality of radiating elements bonded to the foam substrate, and a radome disposed adjacent the radiating elements. The subarray assembly presents a triangular shape when viewed in plan view, and the plurality of radiating elements are arranged in a triangular array on the foam substrate.

In another embodiment, a phased array antenna assembly comprises a plurality of panels, each panel comprising a plurality of antenna subarray assemblies. At least one of the subarray assemblies comprises a thermally conductive foam substrate, a plurality of radiating elements bonded to the foam substrate, and a radome disposed adjacent the radiating elements. The subarray assembly presents a triangular shape when viewed in plan view, and the plurality of radiating elements are arranged in a triangular array on the foam substrate.

In a further embodiment, an aircraft comprises a communication system and a phased array antenna assembly coupled to the communication system and comprising a plurality of panels. Each panel comprising a plurality of antenna subarray assemblies, and at least one of the subarray assemblies comprises a thermally conductive foam substrate, a plurality of radiating elements bonded to the foam substrate, and a radome disposed adjacent the radiating elements. The subarray assembly presents a triangular shape when viewed in plan view, and the plurality of radiating elements are arranged in a triangular array on the foam substrate.

Further areas of applicability will become apparent from the description provided herein. It should be understood that the description and specific examples are intended for purposes of illustration only and are not intended to limit the scope of the present disclosure

BRIEF DESCRIPTION OF THE DRAWINGS

Embodiments of methods and systems in accordance with the teachings of the present disclosure are described in detail below with reference to the following drawings.

DETAILED DESCRIPTION

Configurations for antenna subassemblies suitable for use in phased array antenna systems, and antenna systems incorporating such subassemblies are described herein. Specific details of certain embodiments are set forth in the following description and the associated figures to provide a thorough understanding of such embodiments. One skilled in the art will understand, however, that alternate embodiments may be practiced without several of the details described in the following description.

The invention may be described herein in terms of functional and/or logical block components and various processing steps. For the sake of brevity, conventional techniques related to inertial measurement sensors, GPS systems, navigation systems, navigation and position signal processing, data transmission, signaling, network control, and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in a practical embodiment.

The following description may refer to components or features being "connected" or "coupled" or "bonded" together. As used herein, unless expressly stated otherwise, "connected" means that one component/feature is in direct physically contact with another component/feature. Likewise, unless expressly stated otherwise, "coupled" or "bonded" means that one component/feature is directly or indirectly joined to (or directly or indirectly communicates with) another component/feature, and not necessarily directly physically connected. Thus, although the figures may depict example arrangements of elements, additional intervening elements, devices, features, or components may be present in an actual embodiment.

Figure 1:
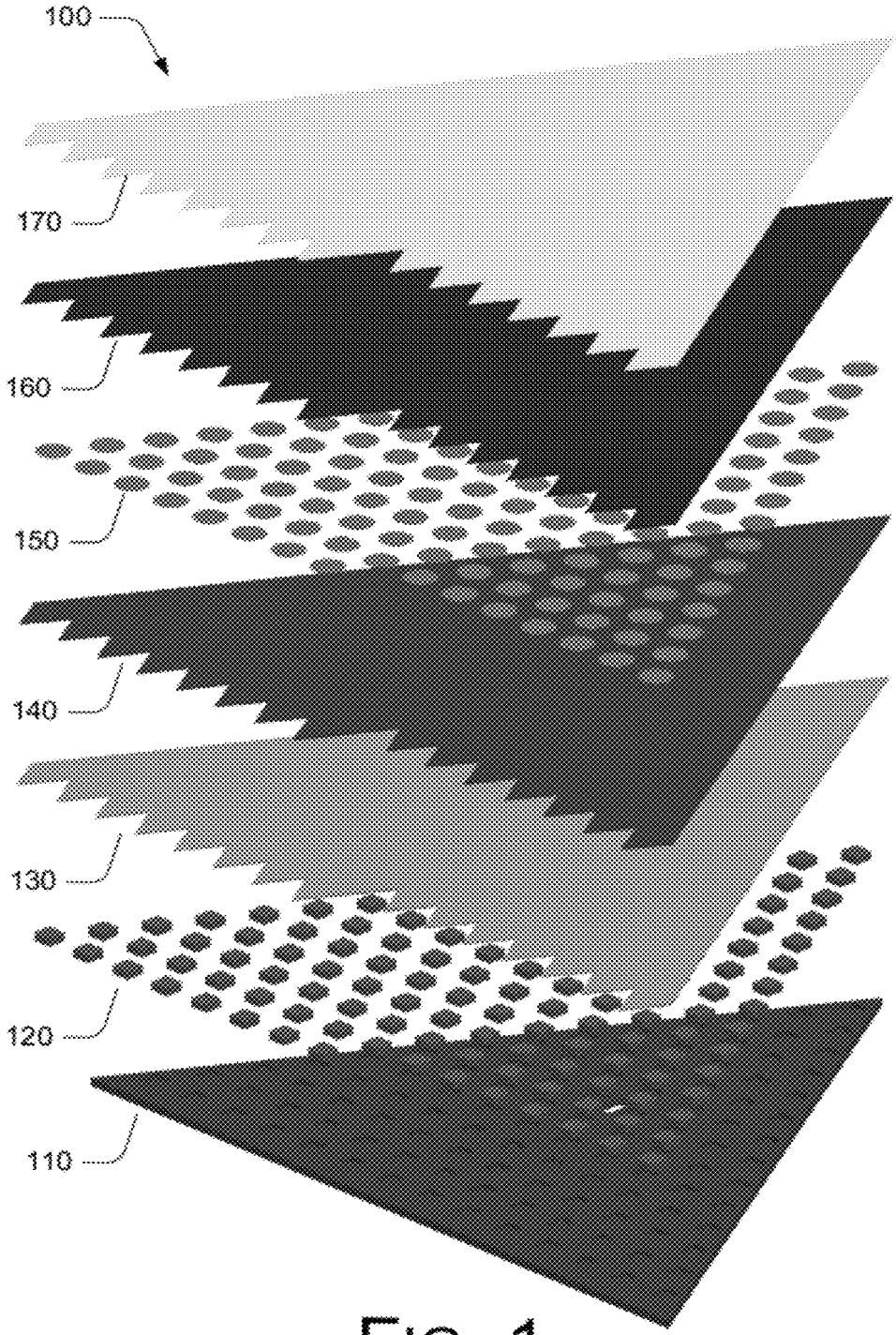
FIG. 1 is a schematic exploded, perspective view of an antenna subarray assembly, according to embodiments.

FIG. 1 is a schematic exploded, perspective view of an antenna subarray assembly, according to embodiments. In the embodiment depicted in FIG. 1 the subarray assembly 100 is formed in a layered construction and comprises, in order from the bottom up, a heat sink 110, a plurality of amplifiers 120, a printed wiring board 130, a foam layer 140, a plurality of radiating elements 150, an adhesive layer 160, and a radome 170.

The radome 170 may be constructed of any suitable material that is essentially transparent to radio frequency (RF) radiation. For example, the radome 170 may be constructed of KAPTON®. Alternatively, the radome 170 may be constructed as a multilayer laminate.

The adhesive layer 160 may comprise an electrostatically dissipative adhesive to bond the radome 170 to the foam layer 140. The adhesive 160 extends over and around of the radiating elements 150 and physically contacts the radiating elements 150. The adhesive 160 allows any electrostatic charge buildup on the radiating elements 150 to be conducted away from the radiating elements 150. It will be appreciated that the electrostatically dissipative adhesive layer 160 will be coupled to ground when the radiator assembly 100 is supported on the printed wiring board 130 shown in FIG. 1. The electrostatically dissipative adhesive 160 may be formed from an epoxy adhesive, a polyurethane based adhesive or a Cyanate ester adhesive, each doped with a small percentage, for example five percent, of conductive polyaniline salt. The precise amount of doping will be dictated by the needs of a particular application.

The electrostatically dissipative adhesive layer 160 also helps to form a thermally conductive path to the foam substrate 140 and eliminates a gap that might otherwise exist between the radome 170 and the top level of radiating elements 150. By eliminating the gap between the inner surface of the radome 170 and the radiating elements 150, a thermal path is formed from the radome 170 through the layer of radiating elements 150.

The radiating elements 150 are arranged in a triangular array on the foam substrate 140. The radiating elements 150 may be thought of as floating with respect to ground metal patches. While the radiating elements 150 are shown as having a generally cirular shape in FIG. 1 it will be appreciated that the radiating elements 150 could have been formed to have any other suitable shape, for example that of a square, a hexagon, a pentagon, a rectangle, etc. Also, while only one layer of radiating elements have been shown, it will be appreciated that the assembly 100 could comprise two or more layers of radiating elements to meet the needs of a specific application. Aspects of the radiating elements 150 will be discussed in greater detail with reference to FIGS. 2-3, below.

In one embodiment the foam substrate 140 may be formed from a low RF loss, syntactic foam material which provides a thermal path through the layer of radiating elements 150. Thus, no "active" cooling of the radiator assembly 10 is required. By "active" cooling it is meant a cooling system employing water or some other cooling medium that is flowed through a suitable network or grid of tubes to absorb heat generated by the assembly 100 and transport the heat to a thermal radiator to be dissipated into space. The use of active cooling significantly increases the cost and complexity, size and weight of a phased array antenna system. Thus, the passive cooling that may be achieved through the use of the syntactic foam substrate 140 allows the subarray assembly 100 to be made to smaller dimensions and with less weight, less cost and less manufacturing complexity than previously manufactured phased array radiating assemblies.

In some embodiments the syntactic foam substrate 140 may be formed as fully-crosslinked, low density, composite foam substrate that exhibits low loss characteristics in the microwave frequency range. The foam substrate 140 may have a dielectric constant that measures between 1.25 and 1.30 over a frequency range that extends between 10 GHz and 30 GHz and a loss tangent of approximately 0.025 over the same frequency range. Advantageously, the loss tangent is relatively constant over a wide bandwidth and from about 12 GHz to about 33 GHz. The thermal resistance of the foam substrate 140 is preferably less than about 50.2 degrees C./W. The foam substrate 140 also preferably has a thermal conductivity of at least about 0.0015 watts per inch per degrees C. (W/inC), or at least about 0.0597 watts per meter per degree Kelvin (W/mK). One particular syntactic foam that is commercially available and suitable for use is DI-STRATE™ foam tile available from Aptek Laboratories, Inc. of Valencia, Calif.

In some embodiments the printed wiring board (PWB) 130 may be formed from a conventional PWB material, e.g., a Rogers 4003 series dielectric PWB material. A plurality of amplifiers 120 may be disposed between the PWB 130 and the heat sink module 120. In some embodiments the plurality of amplifiers may be implemented as an array of monolithic microwave integrated circuits (MMICs) which are coupled to a power source and controller by circuit traces in the PWB 130.

In some embodiments the heat sink module 110 may be formed from a phase change material which utilizes heat energy generated by the MMICs to effect a phase change of the material in the heat sink module 110. The particular material from which the heat sink module 110 is formed is not critical. Examples of suitable materials include paraffin and other types of wax which melt at well known temperatures. The particular type of wax or other material used will determine the temperature at which the heat sink will begin to store excess thermal energy.

The various components depicted in FIG. 1 may be assembled to form an antenna subarray assembly 100 substantially in accordance with the description provided in commonly assigned U.S. patent application Ser. No. 12/121,082 to McCarthy, et al., the disclosure of which is incorporated herein by reference in its entirety. Although the thickness of the various layers shown in FIG. 1 may vary to meet the needs of a specific application, in one example the syntactic foam substrates 140 measures between about 0.045 inch-0.055 inch (1.143 mm-1.397 mm) thick. The electrostatically dissipative adhesive layer 160 may vary in thickness, but in one embodiment measures between about 0.001 inch-0.005 inch (0.0254 mm-0.127 mm) thick. The radome 170 typically may be between about 0.003 inch-0.005 inch (0.0762 mm-0.127 mm) thick.

Figure 2:
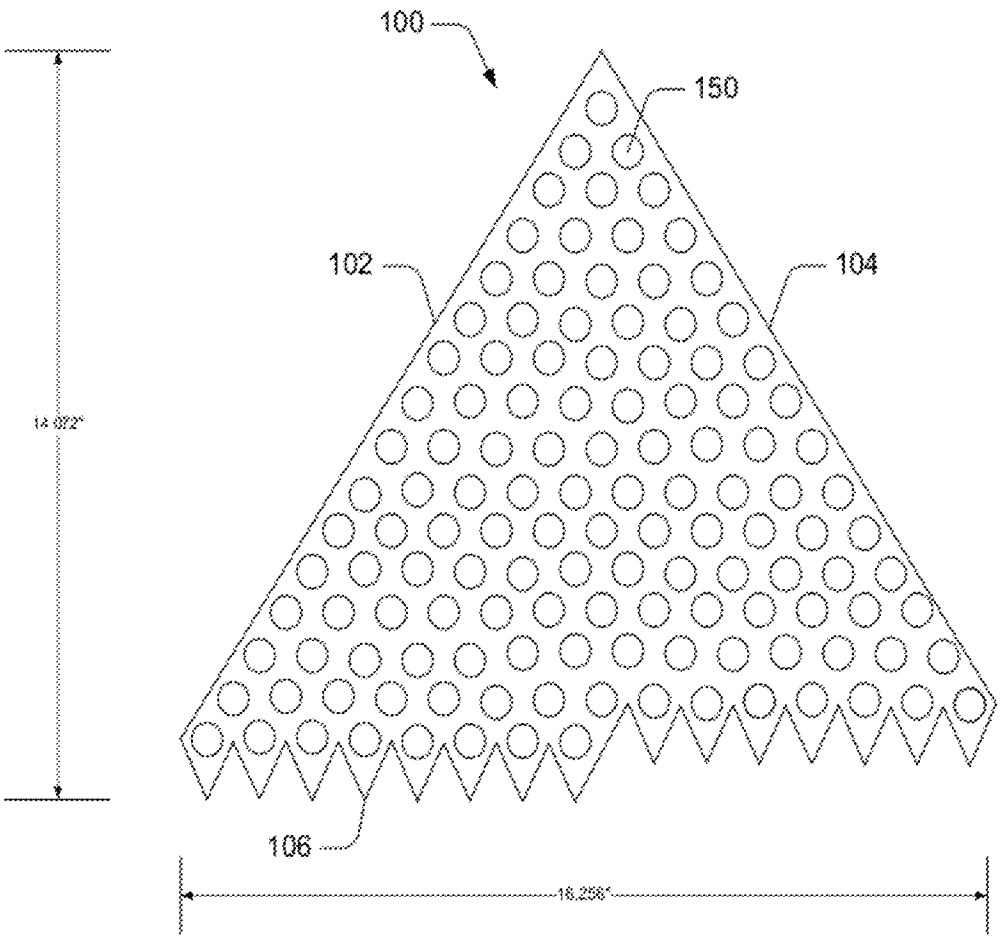
FIG. 2 is a schematic top, plan view of an antenna subarray assembly, according to embodiments.

FIG. 2 is a schematic top, plan view of an antenna subarray assembly 100, according to embodiments. Referring to FIG. 2, the subarray assembly 100 forms a triangle when viewed in a top plan view. The triangle includes a first edge 102 and a second edge 104 that are substantially smooth, and a third edge 106 that presents a sawtooth pattern. In one embodiment the subarray measures 14.072 inches (35.74 cm) in height and 16.256 inches (41.29 cm) in width, such that the surface area of the subassembly is approximately 114.377 square inches (0.0738 square meters). One skilled in the art will recognize that the size of the antenna subarray assembly 100 may vary depending upon the particular application.

The radiating elements 150 are arranged in a triangular array on the substrate 140. Similarly, the MMICs 140 are arranged in a triangular array on the heat sink layer 110, but are not visible in FIG. 2. In some embodiments the radiating elements measure approximately 0.638 inches (1.62 cm) in diameter. The radiating elements are positioned in horizontal rows such that the centers of adjacent elements within a row are displaced by approximately 1.016 inches (2.58 cm). The rows are displaced by 0.879" (2.23 cm). In the embodiment depicted in FIG. 1 there are 128 radiating elements, which permits the use of a corporate manifold and conventional 3 dB Wilkinson power dividers/combiners to drive the antenna. One skilled in the art will recognize that the particular configuration of the radiating elements on the antenna subarray assembly 100 may vary depending upon the particular application.

Figure 3:
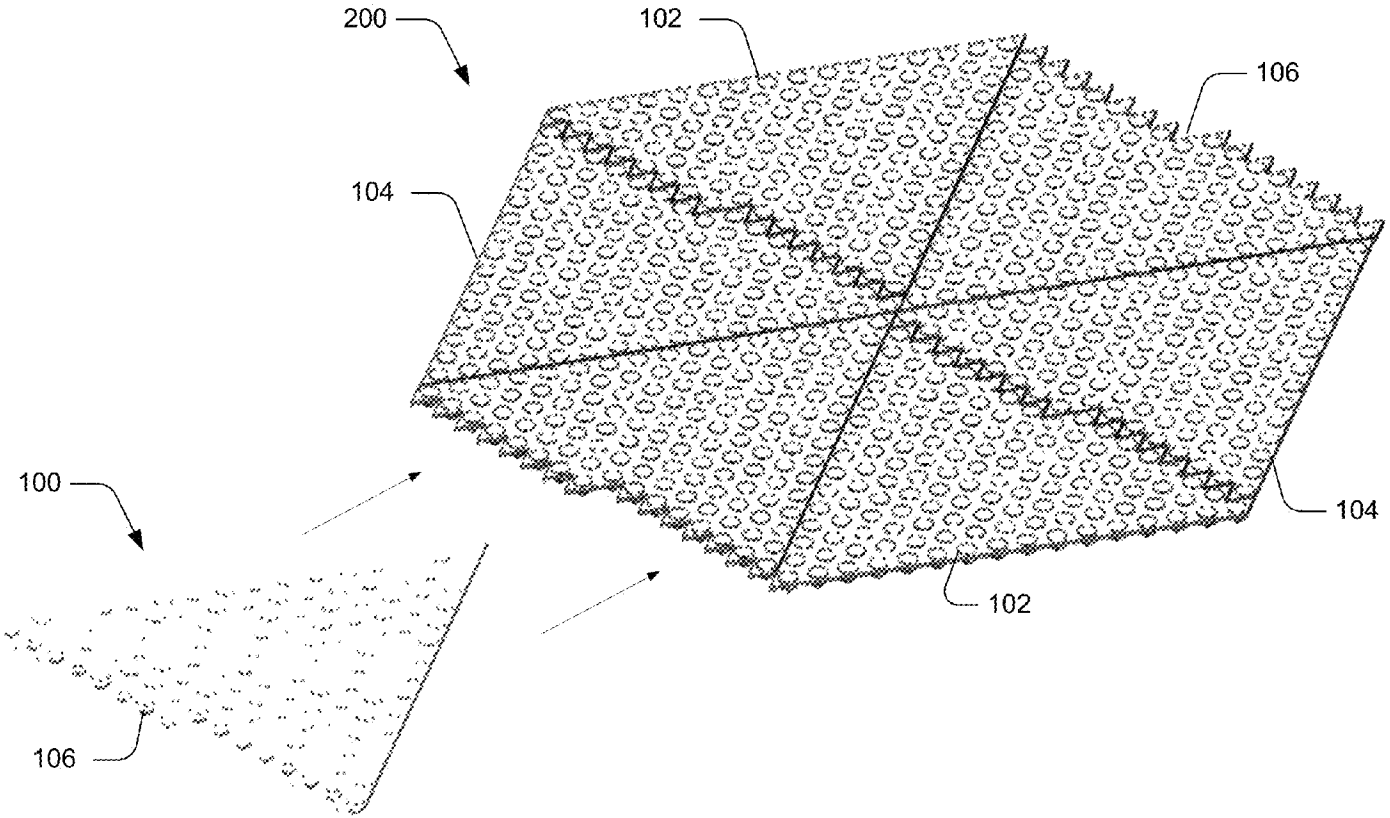
FIG. 3 is a schematic perspective view of an antenna panel, according to embodiments.
Figure 4:
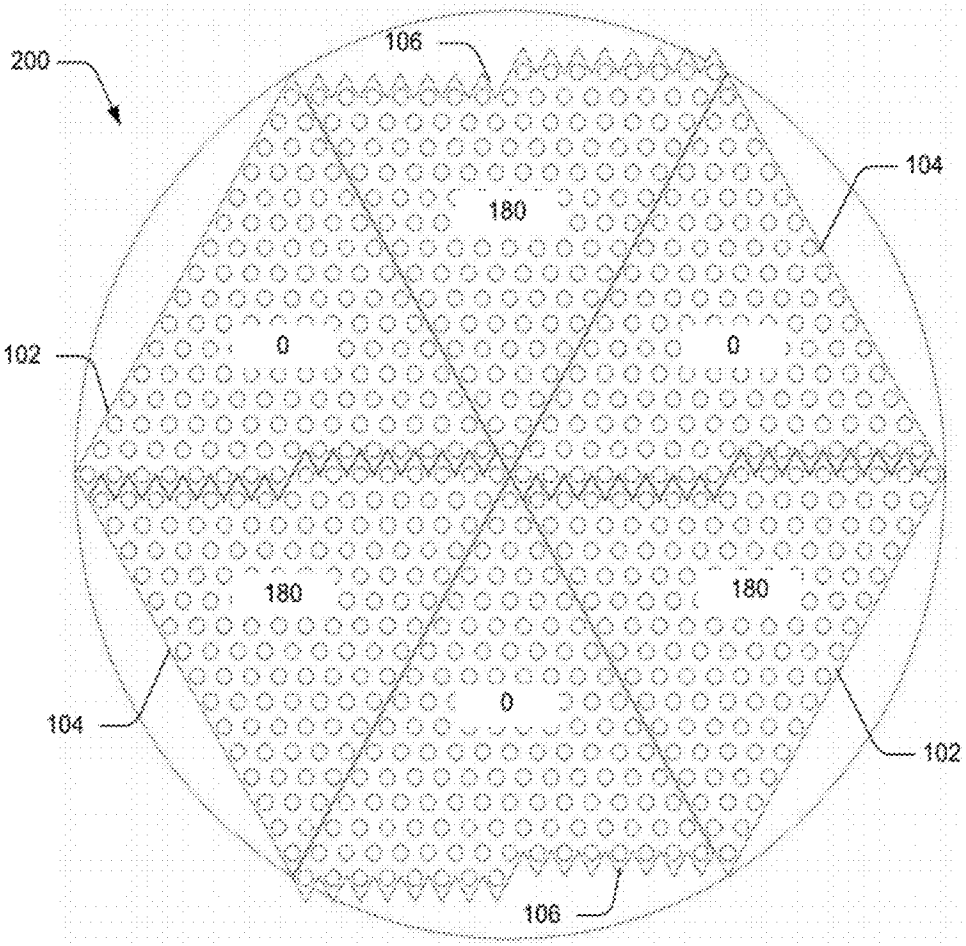
FIG. 4 is a schematic top, plan view of an antenna panel, according to embodiments.

Six triangular subarray assemblies 100 may be assembled to form a antenna panel 200, as indicated in FIGS. 3 and 4. The respective array assemblies may be secured in place by mounting them on a common substrate. As indicated in FIG. 4, the respective assemblies 100 may be arranged that adjacent subarrays 100 are 180 degrees out of phase with one another. Since the subarrays are out of phase by 180 degrees, 180 degree hybrid couplers (rat-race couplers) can be used to combine the signals from multiple subarrays. One skilled in the art will recognize that the hexagonal antenna array approximates a circular array. As such, a hexagonal can be used as a feed for a cassegrain dual-reflector antenna where the hexagonal phased array is in front of the focus.

Figure 5:
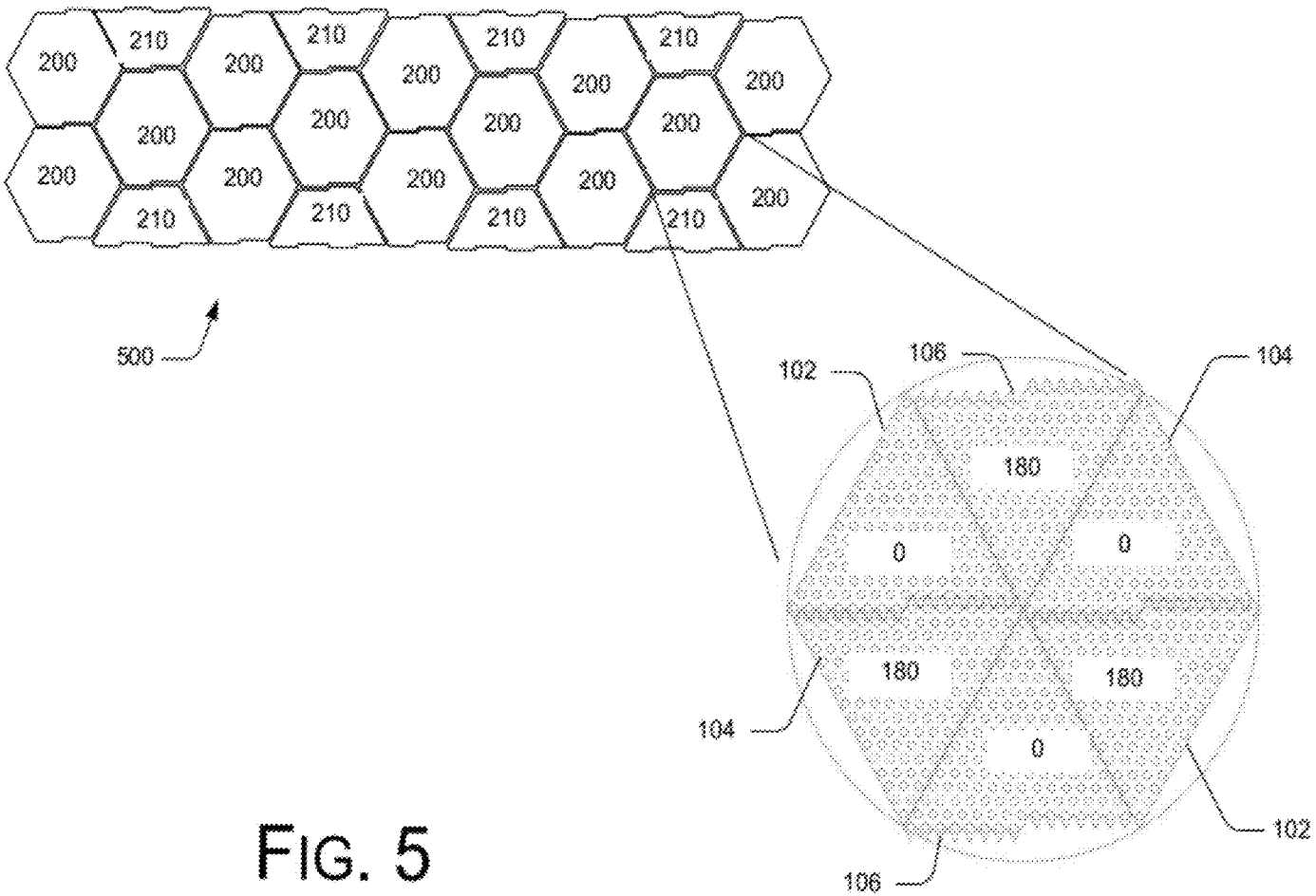
FIG. 5 is a schematic top, plan view of an antenna, according to embodiments.

A plurality of antenna panels 200 may be combined as illustrated in FIG. 5 to form an antenna assembly 500 which may be coupled to a communication system to provide RF communication with remote devices. As illustrated in FIG. 5, an antenna assembly 500 may comprise full hexagonal panels 200 and half-hexagonal panels 210, which are arranged to form a tightly-packed antenna assembly 500. One skilled in the art will recognize that all subassembly panels 100 are arranged such that they are 180 degrees out of phase with all adjacent subassembly panels 100.

Thus, described herein is a construction for a triangular antenna subarray assembly 100 which may serve as fundamental building block for forming phased array antenna systems, including electronically steerable array antenna (ESA) assemblies. The triangular structure described herein provides numerous advantages over rectangular structures.

From a physical perspective, the use of triangular subassembly 100 provides a standardized building block from which an antenna panel 200 and ultimately an antenna assembly 500 can be formed. The triangular array also provides a space-efficient pattern for antenna elements and can be constructed in relatively large sizes for more efficient manufacture. The design is scalable to accommodate varying sizes of antenna panels 200 and antenna assemblies 500.

From an electrical perspective, the use of triangular subassemblies eliminates or at least reduces several issues associated with rectangular arrays, and particularly with ESA assemblies. Triangular subarray configurations require fewer radiating elements 150 than rectangular arrays to realize the same grating lobe free electronic scan volume. For example, for a maximum grating lobe free scan angle, $\theta_m$, of 20 degrees:

$$1+\sin(\theta_m)=1.342 \quad \text{Eq. 1}$$

Thus for a given wavelength, λ, for a square radiating element grid:

$$\lambda/dx=\lambda/dy=1.342 \text{ or } dx=dy=0.745\ \lambda \quad \text{Eq. 2}$$

And the area required per radiating element is:

$$dxdy=(0.745\lambda)^2=0.555\lambda^2 \quad \text{Eq. 3}$$

By contrast, for a given wavelength, λ, for a square radiating element grid:

$$\lambda/(3dx')^{0.5}=\lambda/dy=1.342 \quad \text{Eq. 4}$$

Which resolves to:

$$dx'=0.430\lambda,\ dy=0.745\lambda \quad \text{Eq. 5}$$

Since radiating elements are offset in a triangular architecture, the area per element is given by:

$$2(dx'dy)=2(0.430\lambda)(0.745\lambda)=0.641\lambda^2 \quad \text{Eq. 6}$$

Thus, for an equivalent scan volume at a 20 degree scan angle, a triangular architecture is approximately 15.5% more efficient than a square architecture.

$$0.641\lambda^2/0.555\lambda^2=1.155 \quad \text{Eq. 7}$$

In addition, the use of GaN high power amplifiers in transmit mode enables higher power efficiency operation. GaN amplifiers can make use of higher drain voltages (25-50V DC) than traditionally used GaAs devices (3-5V DC). For large arrays this provides a net benefit to overall payload power efficiency due to lower power distribution and conversion losses. GaN devices also have higher allowable channel temperatures than GaAs devices. This allows for simpler thermal control architectures.

In some embodiments an vehicle-based communication system may incorporate one or more antennas constructed according to embodiments described herein. By way of example, referring to FIG. 6, exemplary environment 600 in which embodiments of an antenna can be implemented. The environment 600 includes an airborne system 602, such as a GPS platform, satellite, aircraft, and/or any other type of GPS enabled device or system. The environment 600 also includes components 604 of the airborne system 602, mobile ground-based or airborne receiver(s) 606, and a ground station 608. In this example, the airborne system 602 is a GPS platform that is depicted as a GPS satellite which includes a wide beam antenna 610 (also referred to as an "Earth coverage antenna"), and includes a spot beam antenna 612 (also referred to as a "steerable" spot beam antenna), which may be constructed in accordance with the description provided herein. The wide beam antenna 610 and the spot beam antenna 612 each transmit GPS positioning information and navigation messages to the GPS enabled receiver(s) 606. The spot beam antenna 612 provides for the transmission of high intensity spot beams to selected points on the ground without requiring excessive transmitter power.

In this example, the airborne system 602 includes a telemetry and command antenna 614 which can be utilized to communicate with the ground station 608. In various embodiments, the GPS platform 602 can be implemented with any number of different sensors to measure and/or determine an attitude of the satellite, where the "attitude" refers generally to an orientation of an airborne system in space according to latitude and longitude coordinates relative to the orbital plane. The GPS platform can be stabilized along three-axes that, in this example, are illustrated as a pitch axis 616, a roll axis 618, and a yaw axis 620.

The airborne system 602 may includes an antenna positioning system 622 to position a boresight 624 of the spot beam antenna 612, where the boresight refers generally to the axis of an antenna, or a direction of the highest power density transmitted from an antenna. In this example, the antenna positioning system 622 includes a gimbals assembly 626, a housing assembly 628, and roll, pitch, and yaw gyros 630 which can each drift from an orientation reference due to rate bias, scale factor, and measurement noise. Gyro drift errors of the gyros 630 can cause enough variance in the antenna positioning system 622 to cause spot beam antenna pointing error(s) when transmitting GPS signals. A pointing error 632 results in a spot beam 634 that is angularly displaced from a commanded spot beam at the antenna boresight 624.

The airborne system 602 may include a calibration control application 634 (in the components 604) to implement embodiments of GPS gyro calibration. The airborne system 602 also includes various system control component(s) 636 which can include an attitude control system, system controllers, antenna control modules, navigation signal transmission system(s), sensor receivers and controllers, and any other types of controllers and systems to control the operation of the airborne system 602. In addition, the airborne system 602, the receiver(s) 606, and/or the ground station 608 may be implemented with any number and combination of differing components as further described below with reference to the exemplary computing-based device 600 shown in FIG. 6. For example, the receiver 606 and the ground station 608 may be implemented as computing-based devices that include any one or combination of the components described with reference to the exemplary computing-based device 600.

In this example, the ground station 608 includes a pointing error estimator 638 and a gyro calibration application 640 to implement embodiments of GPS gyro calibration. In an embodiment, the GPS platform 602 transmits scan signals 642 to the GPS enabled receiver(s) 606 via the spot beam antenna 612. For example, the scan signals 642 can be transmitted to the GPS enabled receivers 606 via the spot beam 634 which is an inaccurate boresight direction of the spot beam antenna 612.

The scan signals 642 can be transmitted to the GPS enabled receiver(s) 606 with a known amplitude and in a pattern of a pre-determined scan profile. For example, The GPS platform gimbals assembly 626 of the antenna positioning system 622 can slew the spot beam antenna 612 across one or more of the GPS enabled receivers 606 in a known, cross scan pattern. The spot beam antenna 612 can be slewed at a low rate (e.g., 0.1 deg/sec) in azimuth and elevation coordinate frames utilizing a scan pattern that is large enough to produce a noticeable change in signal-to-noise ratio (or carrier to noise) measurements.

The GPS enabled receiver(s) 606 can receive the scan signals 642 transmitted via the spot beam antenna 612 of the GPS platform 602 and determine signal power measurements for each of the scan signals. In an embodiment, the signal power measurements can be determined as signal-to-noise ratio measurements of the scan signals 642. The GPS enabled receiver(s) 606 can also time-tag, or otherwise indicate a time at which a scan signal is received such that each of the scan signals 642 can be correlated with antenna position data 644 to estimate the pointing error 632 of the spot beam antenna 612. The GPS enabled receiver(s) 606 can then communicate the signal power measurements 646 to the ground station 608.

The GPS platform transmits, or communicates, the antenna position data 644 for the spot beam antenna to the ground station 608 where the antenna position data indicates the inaccurate boresight direction 634 of the spot beam antenna 612. Alternatively, the GPS platform 602 can be commanded to point the boresight direction of the spot beam antenna 612 at a particular latitude and longitude where a GPS enabled receiver 606 is located. The accurate latitude and longitude coordinates can also be obtained from the GPS enabled receiver.

The ground station 608 can receive the signal power measurements 646 from the GPS enabled receiver(s) 606. The pointing error estimator 638 at the ground station 608 estimates the pointing error 632 of the spot beam antenna 612 based on the signal power measurements 646 and the antenna position data 644 received from the GPS platform 602. The difference between where a signal-to-noise ratio is measured and where it was expected to be provides an estimate of the antenna pointing error.

The gyro calibration application 640 at the ground station 608 can be implemented to determine gyro calibration parameters from the estimated pointing error 632. The gyro calibration parameters can include a rate bias and a scale factor communicated to the GPS platform. In an embodiment, antenna pointing error measurements are input to a Kalman filter algorithm to estimate the gyro calibration parameters 648 to calibrate for the gyro drift errors.

The gyro rate bias and the scale factor parameters can be resolved for all of the gyros 630 in the three different axes (i.e., pitch axis 616, roll axis 618, and yaw axis 620) by the gyro equation:

$$\omega_{gyro}=(1+SF)\omega_{true}+b_{gyro}+\eta_r$$

where $\omega_{gyro}$ is a gyro reading, SF is the gyro scale factor, $\omega_{true}$ is a true airborne system body rate, $b_{gyro}$ is the gyro rate bias, and $\eta_r$ is the rate noise. Given the $\omega_{gyro}$ gyro reading, the gyro rate bias and the scale factor can be estimated. Estimating the gyro calibration parameters utilizing a Kalman filter algorithm is further described in a document "Precision Spacecraft Attitude Estimators Using an Optical Payload Pointing System", Jonathan A. Tekawy (Journal of Spacecraft and Rockets Vol.35, No.4, July-August 1998, pages 480-486), which is incorporated by reference herein.

The ground station 608 can communicate or otherwise upload the gyro calibration parameters 648 to the GPS platform 602 where the calibration control application 634 can calibrate the gyros 630 for the gyro drift errors. The gyro calibration parameters 648 that are uploaded to the GPS platform can also contain information to correct for the gyro rate output and to provide accurate rate and attitude estimates. With the corrected gyro estimates, the GPS platform 602 can more accurately point both the GPS Earth coverage antenna 610 and the spot beam antenna 612.

Thus, described herein are constructions for antenna subassemblies, antenna assemblies formed from such subassemblies, and aircraft including antennas formed from such subassemblies. A phased array antenna constructed in accordance with the description provided herein can operate in transmit and receive modes. In some embodiments the radiating elements in the antenna may comprise a low noise amplifier (LNA) formed from Gallium arsenide (GaAs) or Indium phosphide (InP) for receive functionality. The GaN power amplifiers improve power efficiency during the high power mode (transmit) and the antenna uses less power while in receive mode. The same corporate combining network may be used to connect the elements in receive mode and transmit mode and is composed of stripline circuitry in the PWB 130.

Figure 6:
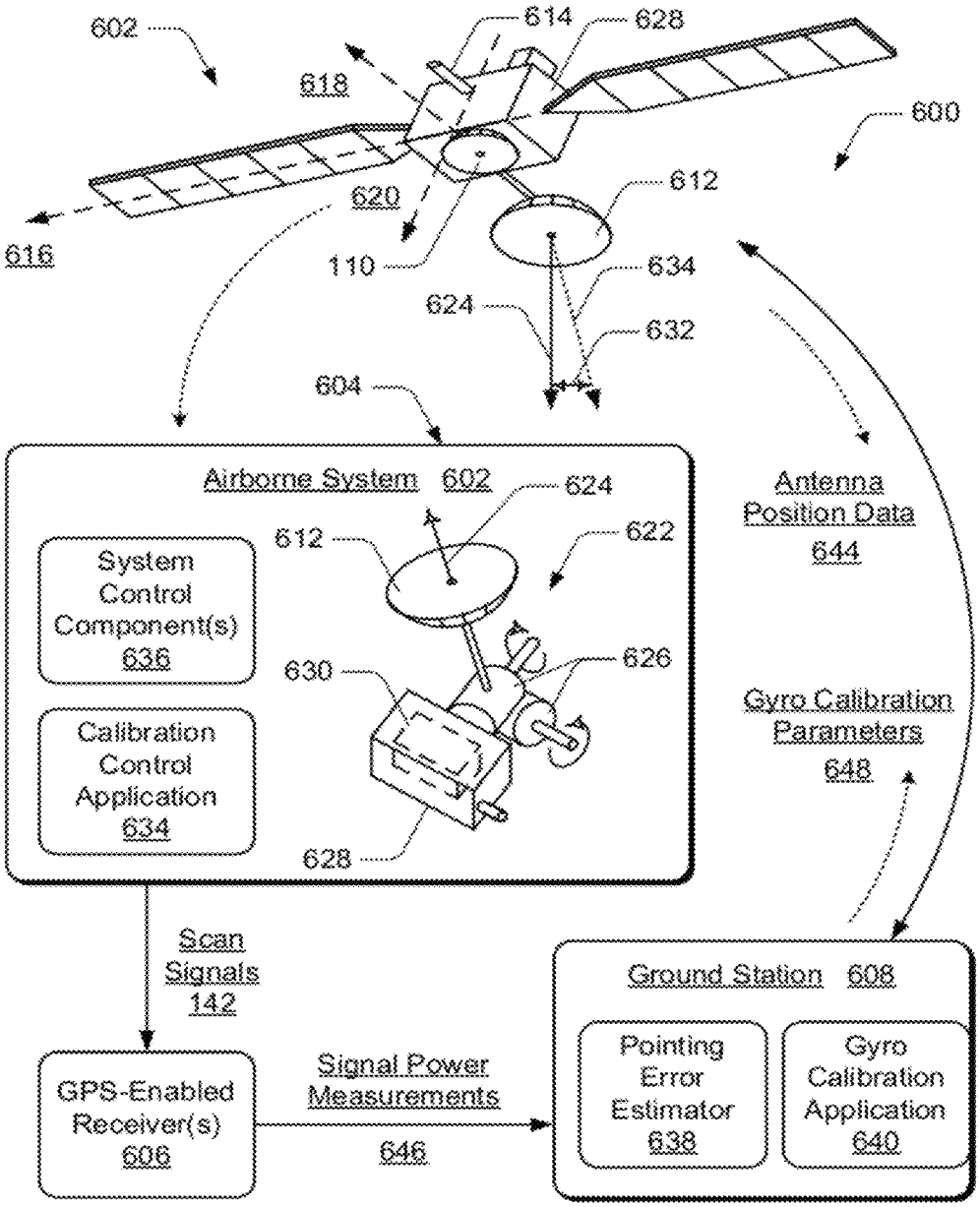
FIG. 6 is a schematic illustration of an aircraft-based communication system which may incorporate an antenna, according to embodiments.

While the embodiment depicted in FIG. 6 illustrates a space-based vehicle, one skilled in the art will recognize that an antenna assembly in accordance with the description provided herein may be implemented on land-based vehicles, water-baesd vehicles, or air-based vehicles. As such, the term "vehicle" should be construed to encompass all such vehicles.

In some embodiments antenna arrays constructed in accordance with the description provided here may be particularly suited for space-based applications due at lest in part to the thermal, electrostatic discharge (ESD), and mass features of the design. However, one skilled in the art will recognize that antenna arrays constructed in accordance with the description provided herein may be used in a wide variety of airborne and terrestrial applications. In addition, antenna arrays constructed in accordance with the description provided herein may be used for in communication systems and radar systems. This provides a particular advantage in radar systems because the same antenna assembly may be used for both transmit and receive modes. For communications system use it provides a compact single antenna solution.

While various embodiments have been described, those skilled in the art will recognize modifications or variations which might be made without departing from the present disclosure. The examples illustrate the various embodiments and are not intended to limit the present disclosure. Therefore, the description and claims should be interpreted liberally with only such limitation as is necessary in view of the pertinent prior art.

What is claimed is:

1. An antenna subarray assembly, comprising:

a thermally conductive foam substrate;

a plurality of radiating elements bonded to the foam substrate; and a radome disposed adjacent the radiating elements, wherein the thermally conductive foam substrate and the radome present a triangular shape when viewed in plan view and comprises at least one edge that presents a sawtooth pattern; and the plurality of radiating elements are arranged in a triangular array on the foam substrate.

2. The antenna subarray of claim 1, further comprising:

a printed wiring board bonded to the thermally conductive foam substrate, wherein the printed wiring board presents a triangular shape when viewed in plan view and comprises at least one edge that presents a sawtooth pattern;

a triangular array of amplifiers disposed adjacent the printed wiring board.

3. The antenna subarray of claim 2, further comprising a heat sink module disposed adjacent the triangular array of amplifiers.

4. The antenna subarray of claim 3, wherein:

the triangular array of amplifiers comprises an array of monolithic microwave integrated circuits (MMICs); and the heat sink module comprises a phase change material.

5. The antenna subarray of claim 4, further comprising a static dissipative adhesive layer disposed on the foam substrate and in contact with the radiating elements and which bonds the radome to the substrate, wherein the printed adhesive layer presents a triangular shape when viewed in plan view and comprises at least one edge that presents a sawtooth pattern.

6. The antenna subarray of claim 1, wherein the thermally conductive foam substrate and the radome present two edges which are smooth.

7. The antenna subarray of claim 2, wherein said static dissipative adhesive comprises an adhesive material doped with polyaniline.

8. The antenna subarray of claim 7, wherein the static dissipative adhesive comprises one of polyurethane, epoxy, and Cyanate ester.

9. A phased array antenna assembly comprising a plurality of panels, each panel comprising a plurality of antenna subarray assemblies, at least one of the subarray assemblies comprising:

a thermally conductive foam substrate;

a plurality of radiating elements bonded to the foam substrate; and a radome disposed adjacent the radiating elements, wherein the thermally conductive foam substrate and the radome present a triangular shape when viewed in plan view and comprises at least one edge that presents a sawtooth pattern; and the plurality of radiating elements are arranged in a triangular array on the foam substrate.

10. The phased array antenna assembly of claim 9, further comprising:

a printed wiring board bonded to the thermally conductive foam substrate, wherein the printed wiring board presents a triangular shape when viewed in plan view and comprises at least one edge that presents a sawtooth pattern;

a triangular array of amplifiers disposed adjacent the printed wiring board.

11. The phased array antenna assembly of claim 10, further comprising a heat sink module disposed adjacent the triangular array of amplifiers.

12. The phased array antenna assembly of claim 11, wherein:

the triangular array of amplifiers comprises an array of monolithic microwave integrated circuits (MMICs); and the heat sink module comprises a phase change material.

13. The phased array antenna assembly of claim 12, further comprising a static dissipative adhesive layer disposed on the foam substrate and in contact with the radiating elements and which bonds the radome to the substrate, wherein the printed adhesive layer presents a triangular shape when viewed in plan view and comprises at least one edge that presents a sawtooth pattern.

14. The phased array antenna assembly of claim 9, wherein the thermally conductive foam substrate and the radome present two edges which are smooth.

15. The phased array antenna assembly of claim 10, wherein said static dissipative adhesive comprises an adhesive material doped with polyaniline.

16. The phased array antenna assembly of claim 15, wherein the static dissipative adhesive comprises one of polyurethane, epoxy, and Cyanate ester.

17. A vehicle, comprising:

a communication system; and a phased array antenna assembly coupled to the communication system and comprising a plurality of panels, each panel comprising a plurality of antenna subarray assemblies, at least one of the subarray assemblies comprising:

a thermally conductive foam substrate;

a plurality of radiating elements bonded to the foam substrate; and a radome disposed adjacent the radiating elements, wherein the thermally conductive foam substrate and the radome present a triangular shape when viewed in plan view and comprises at least one edge that presents a sawtooth pattern; and the plurality of radiating elements are arranged in a triangular array on the foam substrate.

18. The vehicle of claim 17, further comprising:

a printed wiring board bonded to the thermally conductive foam substrate;

a triangular array of amplifiers disposed adjacent the printed wiring board.

19. The vehicle of claim 18, further comprising a heat sink module disposed adjacent the triangular array of amplifiers.

20. The vehicle of claim 19, wherein:

the triangular array of amplifiers comprises an array of monolithic microwave integrated circuits (MMICs); and the heat sink module comprises a phase change material.

* * * * *